US010926266B2

(12) United States Patent
Berberich et al.

(10) Patent No.: US 10,926,266 B2
(45) Date of Patent: Feb. 23, 2021

(54) HOUSING FOR A LABORATORY APPLIANCE

(71) Applicant: BRAND GMBH + CO KG, Wertheim (DE)

(72) Inventors: Christian Berberich, Neunkirchen (DE); Steffen Gehrig, Walldürn (DE); Thomas Howe, Wertheim (DE); Martin Jungbluth, Überlingen (DE); Peter H. Mahler, Kreuzwertheim (DE); Benjamin Peszleg, Wertheim (DE); Max Petek, Radolfzell (DE); Burkhard Schaub, Eussenheim (DE); Christian Weiner, Rielasingen (DE)

(73) Assignee: BRAND GMBH + CO KG, Wertheim (DE)

( * ) Notice: Subject to any disclaimer, the term of this patent is extended or adjusted under 35 U.S.C. 154(b) by 491 days.

(21) Appl. No.: 15/597,304

(22) Filed: May 17, 2017

(65) Prior Publication Data

US 2017/0333907 A1 Nov. 23, 2017

(30) Foreign Application Priority Data

May 17, 2016 (DE) ..... 20 2016 003 110.5

(51) Int. Cl.
*B01L 1/02* (2006.01)
*B01L 9/06* (2006.01)
*B08B 15/02* (2006.01)

(52) U.S. Cl.
CPC ..... *B01L 9/06* (2013.01); *B01L 1/02* (2013.01); *B08B 15/023* (2013.01); *B01L 2300/06* (2013.01)

(58) Field of Classification Search
CPC .... B01L 1/02; B01L 9/06; B01L 99/00; B01L 2300/06; B08B 15/023
(Continued)

(56) References Cited

U.S. PATENT DOCUMENTS 2,533,561 A * 12/1950 Deibel ..... B08B 15/023 454/56
2,999,448 A * 9/1961 Abler ..... B25H 1/20 454/60
(Continued)

FOREIGN PATENT DOCUMENTS

DE 3939063 A1 * 5/1991 ..... B08B 15/023
DE 102009018124 B3 * 11/2010 ..... B08B 15/023
(Continued)

OTHER PUBLICATIONS

Nichtnennung, DE3939063A1 English machine translation, May 29, 1991 (Year: 1991).*
(Continued)

*Primary Examiner* — Kenneth J Hansen
*Assistant Examiner* — Phillip Decker
(74) *Attorney, Agent, or Firm* — David S. Safran; Roberts Calderon Safran & Cole, P.C.

(57) ABSTRACT

A housing for a laboratory appliance with a floor, ceiling, rear wall, side walls and front wall, which together enclose a work space. The front wall is movable between closed position and open positions. A work area in which liquids can be handled is provided in the work space. A filter device for ambient air is connected to the work space via at least one air outlet. At least one air inlet is connected to the environment, and a fan and an air filter are located downstream from the air inlet and upstream from the air outlet. An outflow opening is also located on the housing. The at least one air outlet and the at least one outflow opening are arranged on the housing such that, during operation of the filter device, the filter air stream flows substantially parallel to and along the work area.

21 Claims, 7 Drawing Sheets

(58) Field of Classification Search
USPC ..... 454/56
See application file for complete search history.

(56) References Cited

U.S. PATENT DOCUMENTS 3,021,776 A * 2/1962 Kennedy ..... B08B 15/023 454/57
3,273,323 A * 9/1966 Whitfield ..... B08B 15/023 55/385.2
3,318,076 A * 5/1967 Baker ..... B08B 15/023 55/350.1
3,494,112 A * 2/1970 Deckas ..... B08B 15/023 55/470
3,703,801 A * 11/1972 Deckas ..... B08B 15/02 55/385.2
3,874,754 A * 4/1975 Saunders ..... B01L 1/04 312/209
3,926,597 A * 12/1975 Landy ..... B08B 15/023 55/338
4,016,809 A * 4/1977 Austin ..... B25H 1/20 454/60
4,252,054 A * 2/1981 Bakels ..... A61C 17/04 312/209
4,489,645 A * 12/1984 Sirch ..... B01L 1/04 454/187
4,550,650 A * 11/1985 Denner ..... B08B 15/023 454/57
5,816,906 A * 10/1998 Mai ..... A45D 29/00 454/56
5,853,361 A * 12/1998 Kobayashi ..... A61G 11/00 600/22
5,946,221 A * 8/1999 Fish, Jr. ..... B08B 15/023 700/276
5,997,397 A * 12/1999 Frickel ..... B08B 15/023 312/209
6,089,970 A * 7/2000 Feustel ..... B08B 15/023 454/57
6,335,166 B1 * 1/2002 Ammann ..... B01F 9/0001 435/6.11
6,368,206 B1 * 4/2002 Hunter ..... B08B 15/023 312/209
6,428,408 B1 * 8/2002 Bell ..... B01L 1/50 454/56
6,461,233 B1 * 10/2002 Gilkison ..... B08B 15/023 454/56
6,517,429 B1 * 2/2003 O'Connell ..... B08B 15/026 454/56
6,623,538 B2 * 9/2003 Thakur ..... B01D 46/0023 454/187
6,874,331 B2 * 4/2005 Chandler ..... A47F 3/0447 454/193
6,899,848 B1 * 5/2005 Chen ..... G01N 35/028 422/535
6,976,911 B2 * 12/2005 Lanham ..... F24F 3/16 236/49.1
7,335,243 B2 * 2/2008 Homan ..... A61G 10/023 55/385.2
7,438,638 B2 * 10/2008 Lewis, II ..... H05K 9/0041 361/679.48
7,776,584 B2 * 8/2010 Richmond ..... G01N 33/56966 435/309.1
7,985,382 B1 * 7/2011 Henry ..... E04H 1/1277 422/291
8,382,873 B2 * 2/2013 Ono ..... A47B 81/00 55/385.2
8,726,539 B2 * 5/2014 Potter ..... F26B 3/04 34/427
8,915,984 B2 * 12/2014 Kawasaki ..... B01L 1/04 312/1
8,932,543 B2 1/2015 Bui et al.
8,968,061 B2 * 3/2015 Chalou ..... B08B 15/02 454/61
9,593,859 B2 * 3/2017 Niazi ..... C12M 29/06
9,833,778 B2 * 12/2017 Rindoks ..... B01L 1/00
9,983,050 B2 * 5/2018 Ettig ..... G01G 21/286
10,758,880 B2 * 9/2020 Collins, Jr. ..... B01L 7/00
2007/0039294 A1 2/2007 Airey
2009/0221059 A1 9/2009 Williams et al.
2012/0077429 A1 * 3/2012 Wernimont ..... F24F 3/161 454/187
2015/0072603 A1 * 3/2015 Spencer ..... B01L 1/025 454/56
2017/0023561 A1 * 1/2017 Martinell Gispert-Sauch ..... G01N 35/00722
2017/0074718 A1 3/2017 Ettig et al.
2018/0326665 A1 * 11/2018 Gatenholm ..... B01L 1/02
2019/0277869 A1 * 9/2019 Stein ..... G01N 35/026

FOREIGN PATENT DOCUMENTS

EP 1 502 649 B1 12/2007
JP 62132550 A * 6/1987 ..... B08B 15/023
WO 2006/049609 A1 5/2006

OTHER PUBLICATIONS

Schaffitzel, DE102009018124B3 English machine translation, Nov. 11, 2010 (Year: 2010).*
Kong, et al., Automatic Liquid Handling for Life Science: A Critical Review of the Current State of the Art, 2012, Journal of Laboratory Automation 17(3) pp. 169-185. (Year: 2012).*
Saito, JP 62-132550 A English machine translation, Jun. 15, 1987 (Year: 1987).*

* cited by examiner

HOUSING FOR A LABORATORY APPLIANCE

CROSS-REFERENCE TO RELATED APPLICATIONS

The present U.S. application is related to and claims priority of German utility model application 20 2016 003 110.5 of May 17, 2016. The aforementioned German application is fully incorporated by reference into the present application.

BACKGROUND OF THE INVENTION

Field of the Invention

The invention relates to a housing for a laboratory appliance.

Description of Related Art

In the prior art from which the invention proceeds, a laboratory appliance in the form of a device for picking up animal cell colonies is located in the work space of the housing. A camera, which is movable by means of a positioning device, identifies animal cell colonies in a medium located in a sample container. By means of a picking head movable parallel to the camera, the medium is sucked out of one of the sample containers and in each case transferred into another sample container. The sample containers are located in a work area in the work space, which work area is oriented in a horizontal plane. The work space, with the laboratory appliance located therein, is surrounded by a substantially gas-tight housing. A filter device is mounted on the ceiling of the housing. By means of the filter device, the work space in the housing can be kept substantially free from contaminating particles. This is done by delivering a filtered filter air stream into the work space through the at least one filter device having a HEPA filter as air filter, such that the work space is always at a slight overpressure in relation to the air pressure in the environment. This prevents air from the environment getting into the work space through gaps that are inevitably present in the housing.

In the above-described, known housing for a laboratory appliance with a filter device through which a filter air stream can be delivered continuously from an air outlet into the work space, the air escapes from the work space in the housing through gaps which are inevitably present in the housing and which are located in particular on the movable front wall via which the work space is accessible from the outside. The filter air stream in the work space flows through the work area, which is defined in the work space and in which the laboratory equipment is located, in different directions not defined from the outset, in particular downward from the air outlet on the filter device and then in the direction of the front wall of the housing. In doing so, the filter air stream crosses parts that are contaminated with adhering particles, for example a movement device for laboratory equipment. The full content of the publication in question, EP 1 502 649 B1, is herewith incorporated by reference into the present application.

Similar circumstances are also found in housings known in practice for laboratory appliances, for example for pipetting robots. For safety reasons, the housings thereof have to be closed during the operation of moved laboratory appliances.

SUMMARY OF THE INVENTION

The subject matter of the present application is a housing with a filter device which delivers a filter air stream into the work space, the achieved result being that the filter air stream passes through the work area in the work space in a substantially defined manner.

The subject matter of the invention is therefore a housing for a laboratory appliance, with floor, ceiling, rear wall, side walls and front wall, which together form a work space enclosed by these, wherein the front wall is movable relative to the housing between a closed position and an open position, wherein the work space is not accessible from the outside in the closed position of the front wall, and wherein the work space is accessible from the outside, at the front of the housing, in the open position of the front wall, wherein a work area, which is oriented in a plane and in which liquids can be handled, is provided in the work space, wherein a filter device for ambient air is arranged on the housing, on the rear wall or on a side wall, and if appropriate on the ceiling, and is connected in flow terms to the work space of the housing via at least one air outlet, wherein the filter device has at least one air inlet connected to the environment, and, downstream from the at least one air inlet and upstream from the at least one air outlet, it has a fan and at least one air filter, wherein a filter air stream can be conveyed from the at least one air outlet into the work space by means of the filter device, wherein at least one outflow opening is provided in a structurally purposeful manner on the housing, in an area matching the position of the at least one air outlet, and wherein the at least one air outlet, on the one hand, and the at least one outflow opening, on the other hand, are arranged on the housing such that, during operation of the filter device, the filter air stream flows substantially parallel to and along the work area.

According to the invention, and in contrast to the prior art, it is not necessary for the work space to be kept permanently at a slight overpressure, in which case this overpressure only declines through leaks via gaps inevitably present on the housing. Instead, provision is made that at least one outflow opening is provided in a structurally purposeful manner on the housing, in an area matching the position of the at least one air outlet. In the housing according to the invention, the at least one air outlet and the at least one outflow opening constitute the decisive parameters for keeping the filter air stream in the work area in a laminar formation and substantially guiding it, irrespective of where and to what extent unavoidable and undesirable leaks are otherwise present.

To this end, according to the invention, provision is made that the at least one air outlet, on the one hand, and the at least one outflow opening, on the other hand, are arranged on the housing such that, during operation of the filter device, the filter air stream flows substantially parallel to and along the work area, preferably substantially horizontally through and/or along the work area. The sample containers and other auxiliary containers or devices used in the work area are often exchanged and are contaminated with particles and microorganisms. A laminar and rectilinear filter air stream across the work area prevents the contamination of the media held in the containers or their transfer through pipette tips.

The laboratory equipment and a movement device, typically arranged in the work space, for the laboratory equipment in the work area inevitably cause deflections and turbulence in the filter air stream. However, the flow of the filter air stream substantially parallel to and along the work area reduces this undefined flow to a minimum.

It is particularly preferable if the arrangement of the at least one air outlet and of the at least one outflow opening is such that the filter air stream flows substantially horizontally in the work space (taking account of any deflections as described above) through and/or along the work area.

In the prior art, the filter air stream is conveyed substantially vertically from the direction of the ceiling into the work space. A filter air stream oriented vertically in this way blows dust, located on a jib of the movement device, into the work area. By contrast, in the design according to the invention, a filter air stream is obtained that is oriented substantially horizontally, i.e. parallel to the work area, and also preferably substantially rectilinearly. Thus, contamination of media is prevented to a very great extent by the orientation of the filter air stream in the work space.

Measurements have shown that it is possible in this way to achieve clean-room class 5 according to ISO 14644-1 or sterile air quality grades according to the manufacturing process guidelines for the pharmaceutical industry (GMP 2007) in the work area.

Explanation of the advantages of the invention and of preferred configurations and developments is made, in conjunction with the explanation of the preferred illustrative embodiments, by reference to the accompanying drawings.

DETAILED DESCRIPTION OF THE INVENTION

Figure 1:
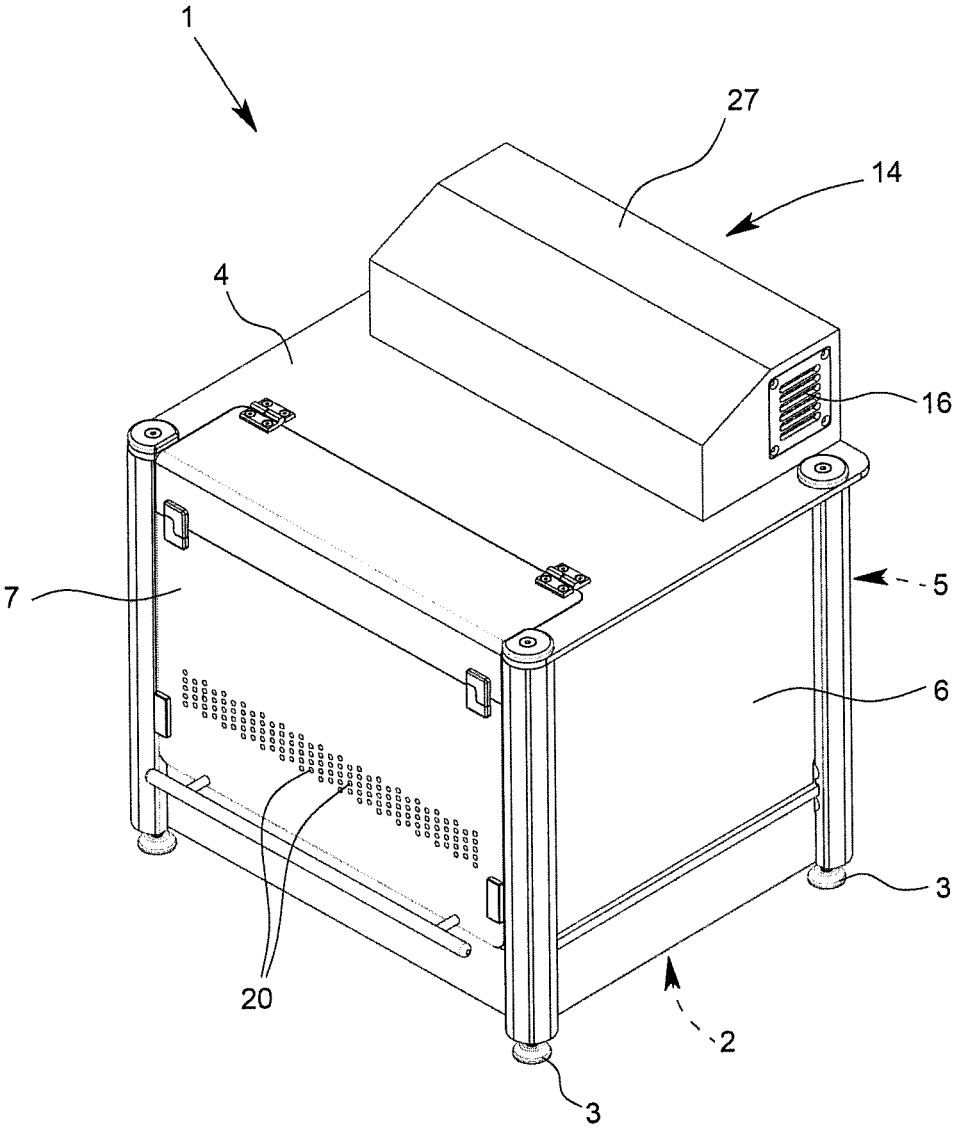
FIG. 1 shows a perspective view of a housing according to the invention, with the front wall located in the closed position.

The subject matter of the invention is a housing 1 for a laboratory appliance. The housing 1 has a floor 2, here with support feet 3, a ceiling 4 closing the housing 1 at the top, a rear wall 5, side walls 6, and a front wall 7. Together, the parts 2, 4, 5 and 6 enclose a work space 8.

In the depicted and in this respect preferred illustrative embodiment, which can be explained on the basis of FIGS. 1 to 4 in combination, the work space 8 of the housing 1 accommodates, as laboratory appliance 9, a pipetting robot which, in the depicted and preferred illustrative embodiment, has a movement device 10 for laboratory equipment 11 in the form of pipettes. With the aid of the pipetting robot, the pipettes interact with the media in various sample-receiving plates 12.

Figure 2:
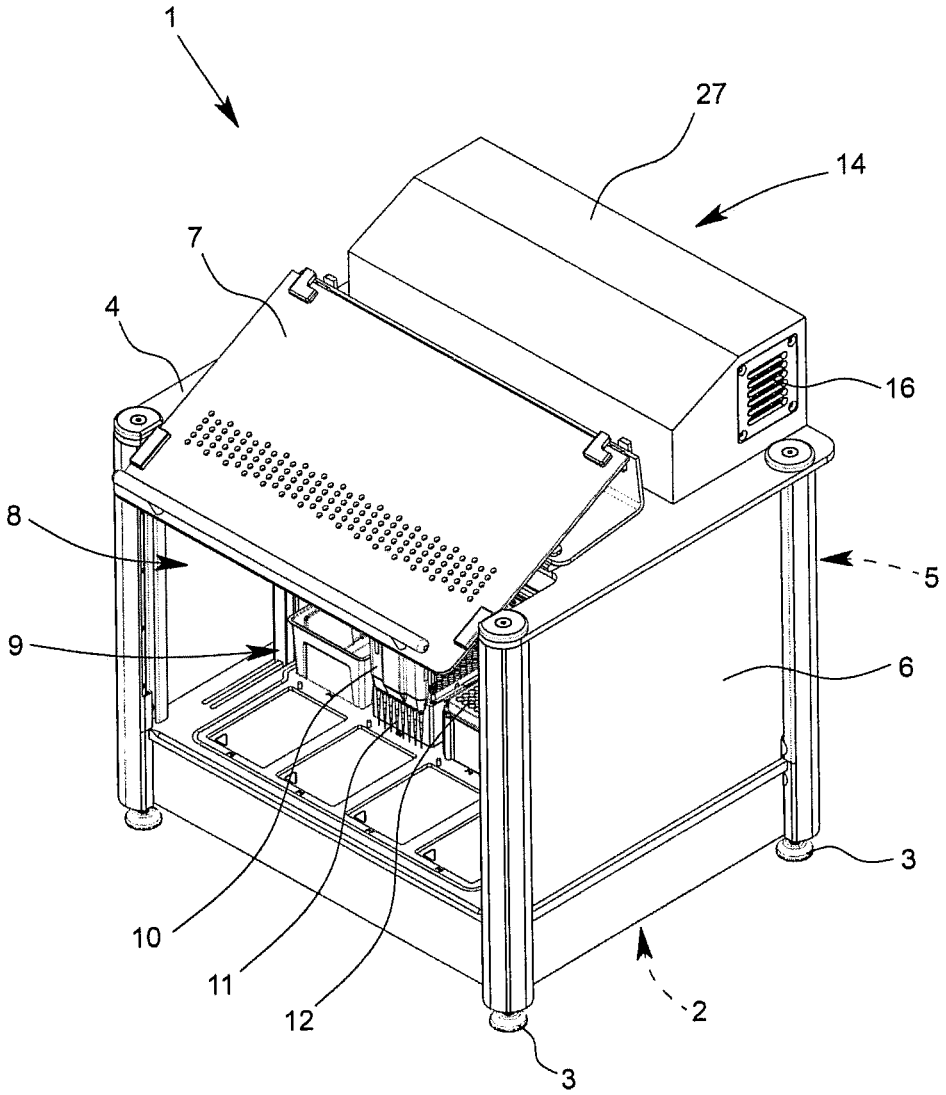
FIG. 2 shows the housing from FIG. 1, with the front wall located in the open position.

From a comparison of FIG. 1, which shows the closed housing 1, and FIG. 2, which shows the opened housing 1, it can be seen that the front wall 7 is movable between a lowered closed position, shown in FIG. 1, and a raised open position, shown in FIG. 2. As FIG. 2 shows, the work space 8 is substantially open at the front in the open position of the front wall 7.

In the illustrative embodiment shown, the side walls 6 of the housing 1 are fixed. It is also possible to use side walls 6 which, as in the prior art discussed in the introduction, are able to open. For details of the design of the specifically depicted illustrative embodiment of a housing 1, reference is made to the full content of Utility Model DE 20 2014 001 872 U1 and corresponding U.S. Patent Application Publication 2017/0074718 A1 which is hereby incorporated by reference As regards the invention in the present case, it is important that a work area 13, which is oriented in the horizontal plane and in which liquids can be handled, is provided in the work space 8. The work area 13 has been indicated by dot-and-dash lines in each of FIGS. 3 and 4. It constitutes the area in which the media are handled, here in the area of the sample-receiving plates 12. This is the sensitive area in which, as far as possible, a rectilinear air cushion composed of clean air is intended to protect the media from contamination.

To achieve the above aim of the invention, a filter device 14 for ambient air is arranged on the housing 1, preferably on the ceiling 4, the rear wall 5 or a side wall 6. In the depicted and in this respect preferred illustrative embodiment, the filter device 14 is located on the ceiling 4 and rear wall 5 of the housing 1.

The filter device 14 is connected in flow terms to the work space 8 of the housing 1 via at least one air outlet 15. The filter device 14 has at least one air inlet 16 connected to the environment. Downstream from the air inlet 16 and upstream from the air outlet 15, the filter device 14 moreover has a fan 17 and at least one air filter 18.

By means of the filter device 14, a filter air stream 19 can be delivered into the work space 8 from the air outlet 15. As a result, the work space 8 in the housing 1 is kept at a certain, albeit slight, overpressure in relation to the environment, thus avoiding a situation in which contaminated air from the environment of the housing 1 gets into the work space 8, and in particular into the work area 13 in the work space 8.

It will also be seen from FIGS. 1 to 4 that, according to the invention, at least one outflow opening 20 is provided structurally on the housing 1, in an area matching the position of the at least one air outlet 15. In the illustrative embodiment shown, the at least one outflow opening 20 can be seen, in FIG. 1, in the movable front wall 7 and, in FIG. 3, on the closed front wall 7. The at least one air outlet 15 can be seen in the cross sections according to FIGS. 3 and 4, but in particular also in the perspective view of the filter device 14 in FIG. 6.

Figure 3:
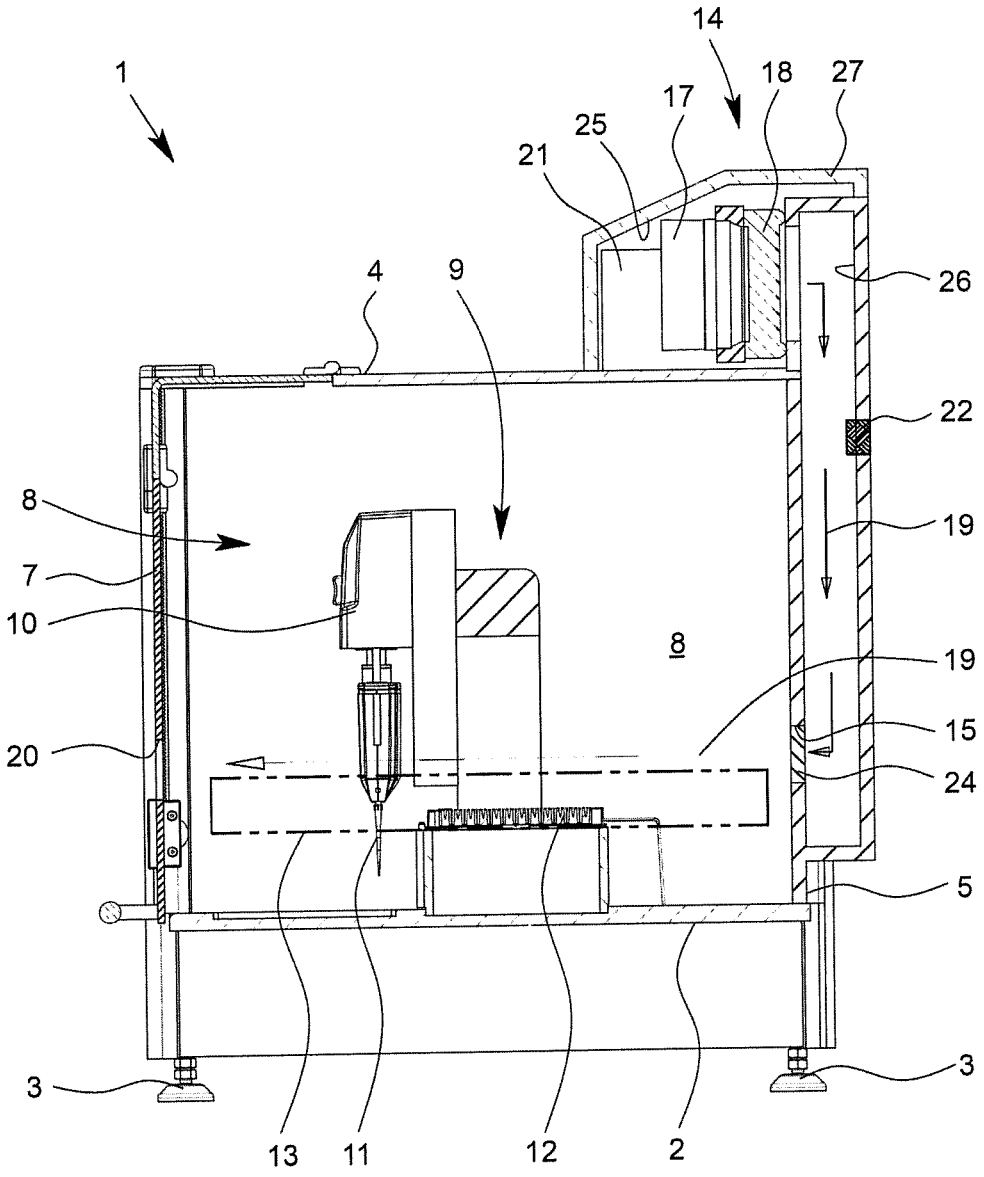
FIG. 3 shows the housing from FIG. 1 in cross section.
Figure 4:
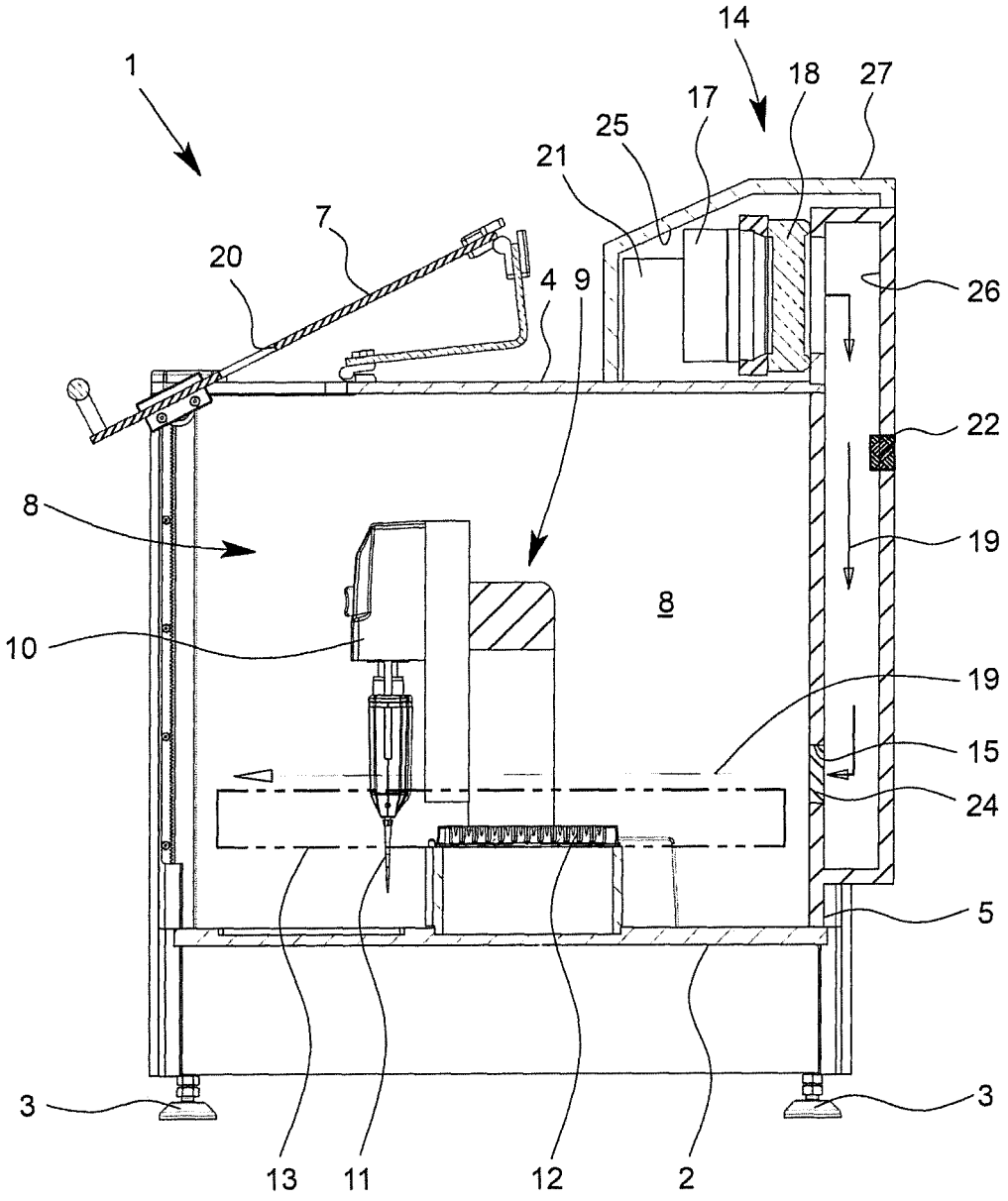
FIG. 4 shows the housing from FIG. 2 in cross section.

It can be seen from FIG. 3 that, according to the invention, the at least one air outlet 15, on the one hand, and the at least one outflow opening 20, on the other hand, are arranged on the housing 1 such that, during operation of the filter device 14, the filter air stream 19 flows substantially parallel to and along the work area 13 in the work space 8, preferably substantially horizontally through or along the work area 13. In FIGS. 3 and 4, this is indicated by an arrow pointing from right to left.

According to the invention, it is essential that the filter air stream 19, which is composed of perfectly filtered air free of particles and microorganisms, flows in a laminar formation, and substantially horizontally, past and over the sample-receiving plates 12 and also past the laboratory equipment 11 and the movement device 10 in the work area 13. In this way, contamination of the media is substantially prevented.

The filter air stream 19 is as clean as the chosen retention capacity of the filters. Measurements with HEPA filters H14 have shown that, with these, clean-room class 5 can be achieved in the work area 13 of the work space 8.

FIG. 3 shows the exact construction according to this preferred illustrative embodiment of the invention, in such a way that the work area 13 is arranged, specifically with its arithmetical midplane, at a defined height above the floor 2 of the housing 1. The at least one air outlet 15 and the at least one outflow opening 20 are arranged approximately in the plane of the work area 13 or slightly higher than the plane of the work area 13. In the depicted and preferred illustrative embodiment, it will be seen from the position of the arrow, depicting the filter air stream 19, that the at least one air outlet 15 and the at least one outflow opening 20 lie slightly higher than the plane of the work area 13 in relation to the floor 2.

In the depicted and preferred illustrative embodiment, the at least one air outlet 15 and the at least one outflow opening 20 lie opposite one another at approximately the same height above the floor 2 of the housing 1, specifically with the at least one air outlet 15 in the rear wall 5 and the at least one outflow opening 20 in the front wall 7.

An arrangement of sample-receiving plates at different heights from the floor 2 is not shown. Such a stepped arrangement defines a work area 13 that extends obliquely in the work space 8. To achieve the aim of the invention, the at least one air outlet 15 and the at least one outflow opening 20 lying opposite are offset in height from the floor 2 and/or have an inclination with respect to the floor 2.

Generally, provision can be made that the at least one air outlet 15 is arranged on a side wall 6 and the at least one outflow opening 20 is arranged on the opposite side wall 6 of the housing 1. Here, provision is preferably made that the at least one air outlet 15 is arranged on the rear wall 5 and the at least one outflow opening 20 is arranged in the front wall 7.

With the depicted and in this respect preferred arrangement of the at least one air outlet 15 and of the at least one outflow opening 20, the additional advantage achieved is that the direction of the filter air stream 19 remains unchanged even when the front wall 7 is opened. Even with the front wall 7 opened, the filter air stream 19 still issuing from the rear wall 5 protects the work area 13 from unfiltered air entering from the outside. This is more favorable than if the arrangements were provided in the side walls.

The depicted and preferred illustrative embodiment also shows that the filter device 14 according to the invention has an electronic control 21, with the aid of which the air delivery of the fan 17 of the filter device 14 can be controlled or regulated. A sensor arrangement 22 is also provided, which is connected to the control 21 and with which the air pressure can be measured at a suitable location in the housing 1 and also outside of the housing 1.

According to the preferred teaching of the invention, provision is made that the filter air stream 19 at the at least one air outlet 15 has a flow speed of 0.15 to 0.6 m/s, preferably approximately 0.3 m/s. Moreover, according to the preferred teaching of the invention, it is recommended for the filter device 14 to be operated in such a way that an air exchange rate of at least 20/h, preferably of 50/h to 200/h, is achieved. According to the very particularly preferred teaching of the invention, an air exchange rate of approximately 125/h is provided in the specifically depicted illustrative embodiment.

The settings outlined above are provided in an attempt to achieve a balance between the required volume of the filter air stream 19, on the one hand, and the swirling, which is to be avoided as far as possible, over or under the filter air stream 19.

The air pressure in the work space 8 can be measured by means of the sensor arrangement 22, and the fan 17 is regulated via the control 21 such that sufficient filter air is at all times fed into the work space 8, in particular into the work area 13.

FIGS. 3 and 4 show in cross section, as has already been discussed, the position of the front wall 7 of the housing 1 when the front side is closed (FIG. 3) and when the front side is open (FIG. 4). According to the preferred teaching of the invention, provision is made that the fan 17 of the filter device 14 is connected in control terms to the movable front wall 7 and that, preferably, the fan 17 can be controlled such that a greater filter air stream 19 can be generated in the open position of the front wall 7 than with the aforementioned values in the closed position of the front wall 7. By virtue of the orientation of the filter air stream 19 above and/or in the work area 13 from the rear wall 5 to the front wall 7 in the depicted and preferred illustrative embodiment, a further improved operating situation is achieved for the laboratory appliance 9 in the housing 1.

Figure 5:
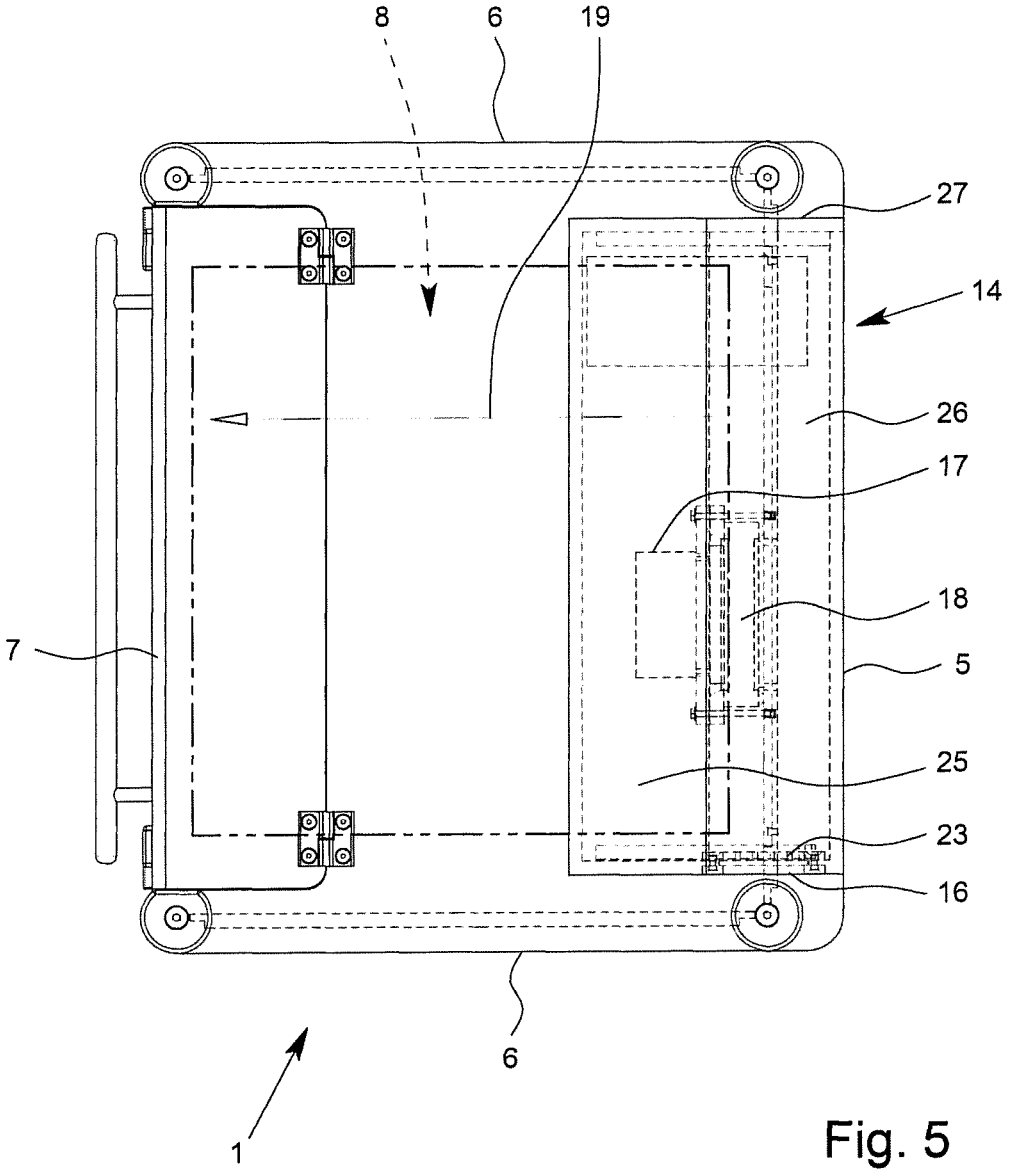
FIG. 5 shows the housing from FIG. 1 in a plan view.

For the filter device 14, it is possible to turn to various suggestions from the prior art. The preferred illustrative embodiment shown in FIGS. 3, 4 and 5 is characterized in that the filter device 14 has, as air filter 18, an HEPA filter 18. Upstream from the air filter 18, preferably at the at least one air inlet 16, the filter device 14 preferably has a pre-filter 23. Downstream from the air filter 18, preferably at the at least one air outlet 15, there is preferably a post-filter 24.

The air filter 18 and/or the pre-filter 23 and/or the post-filter 24 are preferably exchangeable. A pre-filter 23 ensures a longer operating time of the air filter 18, which is particularly significant if the filter in question is a relatively expensive HEPA filter 18. The post-filter 24 holds back contaminants at the at least one air outlet 15.

Figure 6:
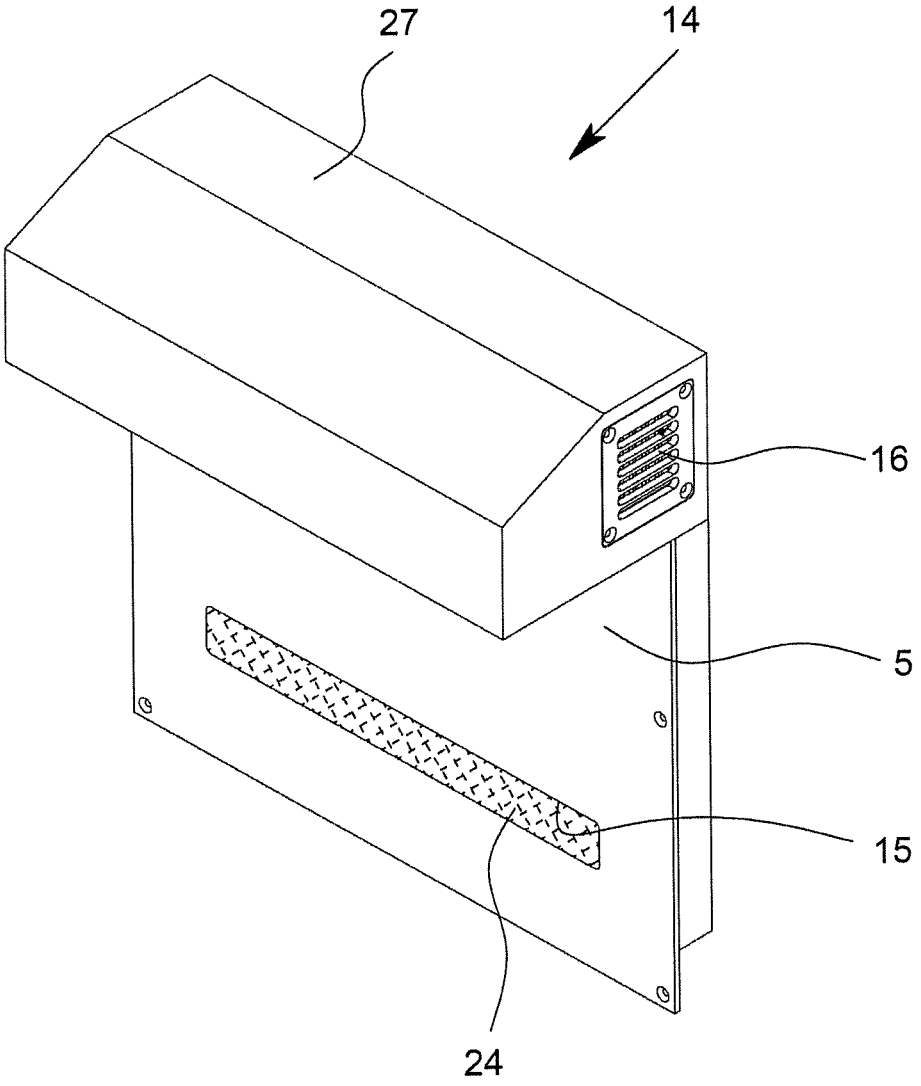
FIG. 6 shows a perspective view of a filter device designed as an autonomous assembly for a housing according to FIG. 1.

When, in accordance with the preferred teaching, the post-filter 24 is arranged on the full surface of the at least one air outlet 15, as is shown in FIG. 6 for example, the post-filter 24 at the at least one air outlet 15 generates a defined flow resistance, such that the filter air stream 19 flows out with a substantially uniform volumetric flow across the entire width or the entire opening cross sections of the at least one air outlet 15.

HEPA filters are classified as such in DIN EN 1822-1 and are already described as special clean-room filters in DE 60 2004 010 578 T2. A concrete example of an HEPA filter 18 is that of the H14 type.

FIGS. 3-6, seen in combination, reveal further particularly preferred aspects of the invention. Here, the filter device 14 has a pre-chamber 25, which is delimited by the pre-filter 23 and the air filter 18 (here an HEPA filter). Moreover, there is a pressure chamber 26 here, which is delimited by the air filter 18 and the post-filter 24. The housing 27 of the filter device 14 can be seen and, on the latter in FIGS. 1 and 2, the air inlet 16 on the end face.

According to the preferred teaching, provision is made that the pressure in the pressure chamber 26 can be measured by means of the sensor arrangement 22, and the fan 17 can be controlled by means of the control 21 such that a pressure in the pressure chamber 26 is between 50 Pa and 150 Pa higher than outside the housing 1.

FIG. 6, in the illustrative embodiment depicted there, shows a single air outlet 15 of the filter device 14, which air outlet 15 is designed as an elongate outlet opening in the horizontal direction with the post-filter 24 located thereon. The post-filter 24 can be composed of a filter mat with the effect of a multiplicity of microscopic air outlets which are defined by the porosity of the post-filter 24. In addition to this filter effect, the porosity results in a defined flow resistance at the at least one air outlet 15, which flow resistance is crucial in generating the rise in pressure in the pressure chamber 26. The pressure difference between pressure chamber 26 and the interior of the housing 1 results in a filter air stream 19 which flows into the work space 8 uniformly from the post-filter 24 across the entire width of the latter.

As can be seen in FIGS. 1 and 2, a multiplicity of outflow openings 20 are arranged on the opposite front wall 7 of the housing 1, which outflow openings 20 are arranged in this area in the manner of a perforated plate. The arrangement and size of the outflow openings 20 is also influenced by the fact that, in any case, undesired penetration into the work space 8 in the housing 1 must be safely avoided.

According to the preferred teaching, and as is shown in FIG. 3, provision is made that the position of the outflow openings 20 in the front wall 7 corresponds approximately to the position of the air outlet 15 provided with the post-filter 24 in the rear wall 5.

By means of the sensor arrangement 22 and the control 21, the filter covering, i.e., the contamination of the filter, can be checked and signaled to a user. The filter air stream 19 can thus be monitored. The delivery volume of the fan 17 can be adapted to the filter covering. Overall, this arrangement permits adequate regulation for the fan 17 of the filter device 14.

According to the invention, a slight overpressure is to be maintained in the work space 8, in particular on the work area 13, of the housing 1, as has already been explained in the prior art. This avoids unintended entry of air into the housing 1 from the outside. A small fraction of the filter air stream 19 flowing into the work space 8 of the housing 1 can escape through gaps that are accidentally but inevitably present. Most of the filter air stream 19 is intended to escape through the outflow openings 20. According to the preferred teaching of the invention, provision is made that the sum of the free cross sections, i.e., the cross-sectional areas, of all the outflow openings 20 is between 20% and 80%, preferably between 25% and 50%, of the sum of the free cross sections of all the air outlets 15.

It will be seen from FIGS. 1 and 2 that the plurality of outflow openings 20 provided in the depicted and preferred illustrative embodiment together form a broad, horizontally arranged area of outflow openings 20 that substantially corresponds in arrangement and orientation to the broad, two-dimensional air outlet 15 with the post-filter 24.

The depicted and in this respect preferred illustrative embodiment in FIGS. 3 and 4 shows clearly that the work space 8 in the housing 1 has a defined inner clearance height and that the at least one air outlet 15 and/or the at least one outflow opening 20, as measured from the top of the floor 2, extends in a range of between 15% and 45%, preferably in a range of between 20% and 35%, of the clearance height of the work space 8.

According to FIGS. 1 & 6, the at least one air outlet 15 is located on the rear wall 5, and the at least one outflow opening 20 is located on the front wall 7. According to the particularly preferred teaching of the invention as depicted here, it is particularly expedient if the at least one air outlet 15 and/or the at least one outflow opening 20 extends in the direction of the width of the rear wall 5 and front wall 7, respectively. It is particularly preferable if the air outlet area formed by the at least one air outlet 15 on the rear wall 5 extends symmetrically across 70% to 90%, preferably about 80%, of the clear width of the rear wall 5 in the work space 8. The area of the outflow openings 20 is similarly configured on the front wall 7.

With the respectively chosen arrangement of the air outlets 15 and of the outflow openings 20, it is possible to influence and adjust the orientation of the filter air stream 19. For example, the density of the openings can be increased toward the side walls 6 in order to counter the diffuse emergence of the filter air stream at gaps of the side walls.

The filter air stream 19 can be further influenced by adjustable guide vanes being arranged downstream from the at least one air outlet 15 in order to guide the filter air stream 19.

FIG. 5 shows the housing 1 according to the invention in a plan view. The component parts of the filter device 14 arranged in the housing 27 of the filter device 14 are indicated by broken lines.

It will be seen from FIG. 6 that, in the depicted and in this respect preferred illustrative embodiment, the filter device 14 is an autonomous assembly. This assembly as a whole can be built onto an existing housing 1 in place of the rear wall 5. The upper part of the filter device 14 with the housing 27 is located above the ceiling 4 of the housing 1, while the rest of the filter device 14 replaces a previously removed rear wall 5 of the housing 1.

An alternative is for the filter device 14 to be constructed from the outset as an integral component part of the housing 1.

Figure 7:
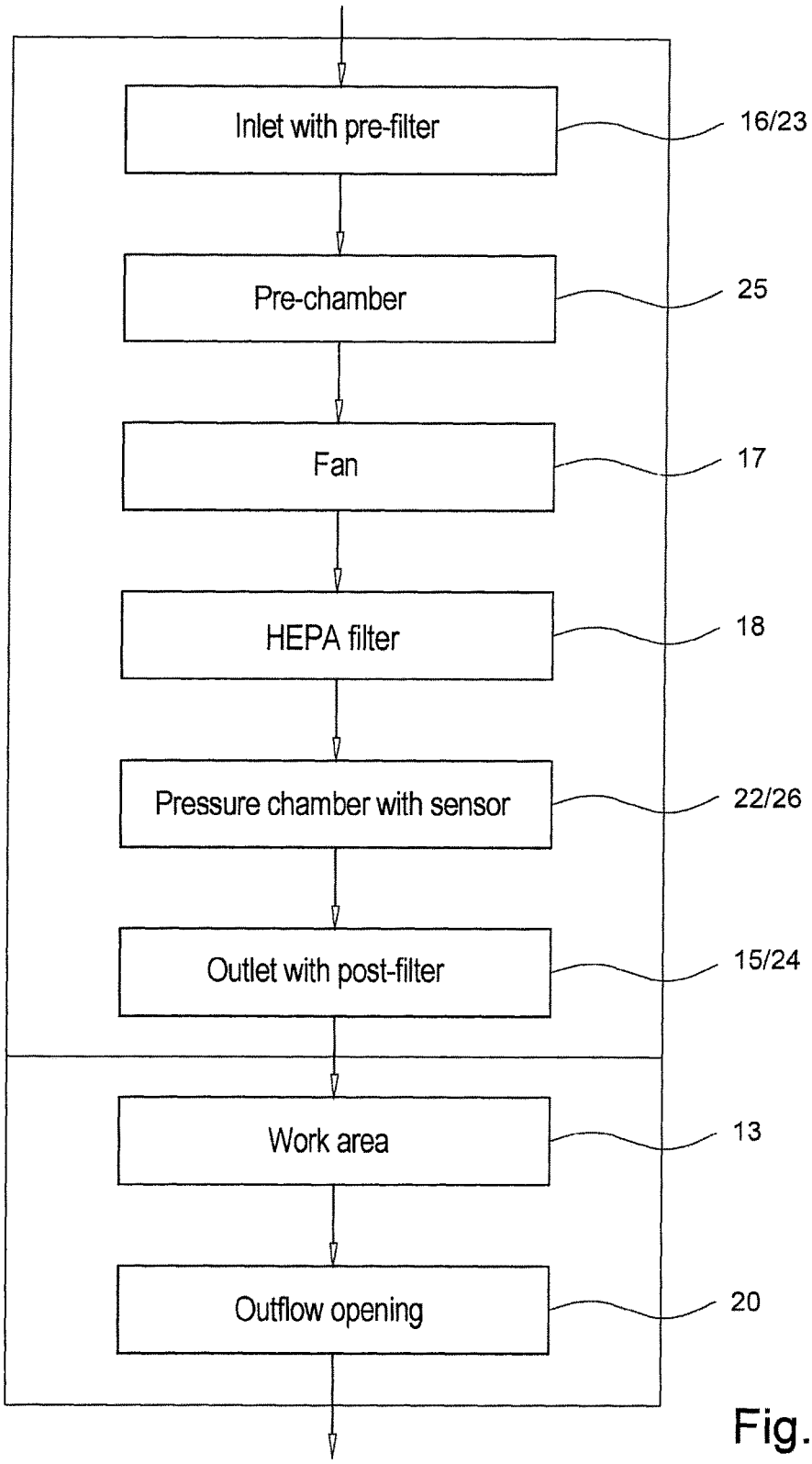
FIG. 7 shows a flow chart for the filter air stream in a housing according to the invention.

FIG. 7 shows the path of the filter air stream 19 from the outside into the work space 8, and in particular into the work area 13 there in the housing 1, and then back out into the environment.

The present description of an illustrative embodiment does not limit the scope of protection of the present invention. The scope of protection is determined exclusively by the claims and also encompasses equivalents of the features referred to in the claims.

What is claimed is:

1. A housing for a laboratory appliance, comprising:

a floor, a ceiling, a rear wall, side walls and a front wall, a work space enclosed by the floor, ceiling, rear wall, side walls and front wall, wherein the front wall is movable relative to the housing between a closed position and an open position, wherein the work space is inaccessible from outside of the housing in the closed position of the front wall, and is accessible from the outside, at the front of the housing, in the open position of the front wall, wherein a work area, which is oriented in a plane and in which liquids can be handled, is provided in the work space, wherein a filter device for ambient air is arranged on the housing and is connected in flow terms to the work space of the housing via at least one air outlet of the filter device, wherein the filter device has at least one air inlet connected to an environment outside of the housing, and, downstream from the at least one air inlet and upstream from the at least one air outlet, it has a fan and at least one air filter, wherein the at least one air outlet is oriented to direct a filter air stream into the work space by means of the filter device, wherein at least one outflow opening is provided on the housing in an area matched to a position of the at least one air outlet, wherein the at least one air outlet and the at least one outflow opening are arranged on the housing in the plane of the work area such that, during operation of the filter device, the filter air stream flows substantially parallel to and along the work area, wherein the work area is arranged at a defined height above the floor of the housing enclosing the work space within an air cushion composed of clean air of the filter air stream to protect liquids being worked upon from contamination, and wherein a sum of free cross sections of all outflow openings is between 20% and 80% of a sum of free cross sections of all of the air outlets so as to create an overpressure in the workspace.

2. The housing as claimed in claim 1, wherein the filter air stream flows substantially horizontally in the work space, through and/or along the work area.

3. The housing as claimed in claim 1, wherein the at least one air outlet and the at least one outflow opening are arranged, in relation to the floor, higher than a plane of the work area.

4. The housing as claimed in claim 1, wherein the at least one air outlet is arranged on the rear wall, and the at least one outflow opening is arranged in the front wall.

5. The housing as claimed in claim 4, wherein air pressure in the housing and outside the housing is measurable, and the fan is controllable by means of a control such that an overpressure in relation to the pressure outside the housing can be generated in the work space.

6. The housing as claimed in claim 5, wherein the filter device has, at the at least one air outlet, a post-filter which is arranged across the whole surface there and through which a defined flow resistance is generated at the at least one air outlet.

7. The housing as claimed in claim 6, wherein the filter device has a pressure chamber, which is delimited by the air filter and the post-filter.

8. The housing as claimed in claim 7, wherein the pressure in the pressure chamber is measurable by means of a sensor arrangement, and the fan is controllable by means of the control such that a pressure in the pressure chamber is between 50 Pa and 150 Pa higher than outside the housing.

9. The housing as claimed in claim 4, wherein the filter device is provided with a control at least for the fan, and the fan is controllable such that the filter air stream at the air outlet has a speed of 0.15 to 0.6 m/s.

10. The housing as claimed in claim 9, wherein the fan of the filter device is controllably connected to the movable front wall, and the fan is controllable such that, in the open position of the front wall, a greater filter air stream can be generated than in the closed position of the front wall.

11. The housing as claimed in claim 1, wherein the filter device is provided with a control at least for the fan, and the fan is controllable such that the filter air stream at the air outlet has a speed of 0.15 to 0.6 m/s.

12. The housing as claimed in claim 11, wherein an air exchange rate of at least 20/h is achievable.

13. The housing as claimed in claim 1, wherein air pressure in the housing and outside the housing is measurable, and the fan is controllable by means of a control such that an overpressure in relation to the pressure outside the housing can be generated in the work space.

14. The housing as claimed in claim 1, wherein the fan of the filter device is connected in control terms to the movable front wall.

15. The housing as claimed in claim 14, wherein the fan is controllable such that, in the open position of the front wall, a greater filter air stream can be generated than in the closed position of the front wall.

16. The housing as claimed in claim 1, wherein the filter device has an HEPA filter as the air filter.

17. The housing as claimed in claim 1, wherein the filter device has, at the at least one air outlet, a post-filter which is arranged across the whole surface there and through which a defined flow resistance is generated at the at least one air outlet.

18. The housing as claimed in claim 17, wherein the filter device has a pressure chamber, which is delimited by the air filter and the post-filter.

19. The housing as claimed in claim 18, wherein a pressure in the pressure chamber is measurable by means of a sensor arrangement, and the fan is controllable by means of a control such that a pressure in the pressure chamber is between 50 Pa and 150 Pa higher than outside the housing.

20. The housing as claimed in claim 1, wherein the at least one outflow opening is a plurality of outflow openings which are arranged in a uniformly distributed manner.

21. The housing as claimed in claim 1, wherein a pipetting robot which has a movement device for laboratory equipment in the form of pipettes is accommodated in the work space of the housing.

* * * * *